United States Patent [19]

Windle

[11] 4,054,513

[45] Oct. 18, 1977

[54] MAGNETIC SEPARATION, METHOD AND APPARATUS

[75] Inventor: William Windle, St. Austell, England

[73] Assignee: English Clays Lovering Pochin & Company Limited, England

[21] Appl. No.: 632,654

[22] Filed: Nov. 17, 1975

Related U.S. Application Data

[63] Continuation-in-part of Ser. No. 486,425, July 8, 1974, abandoned.

[30] Foreign Application Priority Data

July 10, 1973 United Kingdom ..... 32926/73

[51] Int. Cl.[2] ..... B03C 1/00

[52] U.S. Cl. ..... 209/214; 209/223 R; 210/222

[58] Field of Search ..... 210/42, 62, 65, 222, 210/223, 236, 332, 333, 329, 334, 324; 209/214, 215, 217, 222, 223 R, 228, 229, 230

[56] References Cited

U.S. PATENT DOCUMENTS

| | | | |
|---|---|---|---|
| 968,822 | 8/1910 | Weinland | 210/324 |
| 1,001,026 | 8/1911 | Hauer | 210/329 |
| 2,326,484 | 8/1943 | Morton | 210/334 |
| 2,452,220 | 10/1948 | Bower | 210/222 |
| 3,193,100 | 7/1965 | Bloughton | 210/333 |
| 3,482,685 | 12/1969 | Malden et al. | 209/214 |
| 3,503,504 | 3/1970 | Bannister | 209/223 |
| 3,567,026 | 3/1971 | Kolm | 210/222 |
| 3,627,678 | 12/1971 | Marston | 210/222 |
| 3,679,060 | 7/1972 | Smith | 210/333 |
| 3,826,365 | 7/1974 | Mercade | 209/214 |
| 3,920,543 | 11/1975 | Marston et al. | 209/222 |

*Primary Examiner*—Theodore A. Granger
*Attorney, Agent, or Firm*—Armstrong, Nikaido & Marmelstein

[57] ABSTRACT

In the method and apparatus described a high intensity magnetic field is established in a first zone. A quantity of fluid having magnetizable particles suspended therein is passed through a first separating chamber containing magnetizable packing material and disposed within the first zone, so that the magnetizable particles are magnetized by the magnetic field and attracted to the packing material. The first separating chamber is then moved out of the first zone and into a second zone and a second separating chamber containing magnetizable packing material is moved into the first zone. The magnetizable particles attracted to the packing material of the first separating chamber are removed within the second zone; and, concurrently with this process, a further quantity of fluid having magnetizable particles suspended therein is passed through the second separating chamber disposed within the first zone, so that the magnetizable particles are magnetized by the magnetic field and attracted to the packing material. The high intensity magnetic field is at this time continuously maintained in the first zone.

24 Claims, 2 Drawing Figures

MAGNETIC SEPARATION, METHOD AND APPARATUS

This application is a continuation-in-part of my application Ser. No. 486,425 filed on the July 8, 1974 now abandoned.

BACKGROUND OF THE INVENTION

1. Field of the Invention

This invention relates to a method and apparatus for separating magnetisable particles from a fluid in which they are suspended.

2. Description of the Prior Art

It is known from U.S. Pat. No. 2,452,220 in the name of William Leslie Bower to separate ferrous metal particles from a fluid, particularly a liquid such as lubricating oil, by passing the fluid containing the metal particles through a separating chamber containing a plurality of magnetisable balls forming a regular and uniformly arranged system of interstices therebetween, whilst a magnetic field is applied within the separating chamber by means of a permanent magnet. The ferrous particles within the fluid are thereby magnetised and attracted to the magnetisable balls. To remove the ferromagnetic particles attracted to the magnetisable balls from the separating chamber, the permanent magnet may be removed from the vicinity of the separating chamber so that the magnetisable balls are demagnetised and a fluid may be flushed through the separating chamber.

It is also known from U.S. Pat. No. 3,567,026 in the name of Henry H. Kolm to separate magnetisable particles from a fluid by passing the fluid through a substantial volume of ferromagnetic corrosion resistant wool material around which an electromagnet coil, capable of applying a magnetic field to the material of at least 12,000 gauss, is wound. When this field is applied, the magnetisable particles in the fluid are attracted to the material in a similar manner as in the previously described process. To remove the magnetisable particles from the material, the magnetic field is turned off and the material is flushed by a fluid whilst being vibrated by means of an applied A.C. magnetic field.

Furthermore, it has hitherto been usual in magnetic separation apparatus, in which an electromagnetic coil is used to establish a magnetic field in a separating chamber containing a porous packing of magnetisable material, to keep running costs down, while maintaining a high magnetic field in the separating chamber, by providing a massive iron return frame, weighing tens or even hundreds of tons, to minimise the loss of magnetic flux from the region of the separating chamber, and thereby minimise the operating power required to maintain a given high magnetic field.

U.S. Pat. No. 3,627,678 describes such an apparatus, in which the return frame almost completely surrounds the separating chamber. It is not possible to remove the separating chamber from between the pole pieces of the electromagnet coil without first removing a massive iron top member of the return frame.

In order to remove magnetisable particles trapped in the material within the separating chamber, it is necessary to flush out the separating chamber in situ; and the electromagnet coil must, of course, be de-energised before the more strongly magnetisable particles are released from the packing material. This is disadvantageous, since while the coil is de-energised, no magnetic separation can take place. A high proportion of time for which such apparatus is in operation is therefore spent cleaning out the packing material, that is in carrying out a strictly non-productive process.

U.S. Pat. No. 3,627,678 also discloses that the electromagnet coil may operate superconductively and that, in this way, running costs may be reduced, since the reduction in electric power needed to maintain a given field strength which occurs when a superconductive magnet is utilised more than compensates for the power required to refrigerate the magnet coil. However, it is not economic to repeatedly energise and de-energise a superconductive magnet coil.

BRIEF SUMMARY OF THE INVENTION

According to one aspect of the present invention there is provided a method of separating magnetisable particles from a fluid in which they are suspended, which method comprises:

a. establishing a high intensity magnetic field in a first zone;

b. passing a quantity of said fluid having magnetisable particles suspended therein through a first separating chamber containing magnetisable packing material and disposed within the first zone, so that the magnetisable particles are magnetised by the magnetic field and attracted to the packing material;

c. moving the first separating chamber out of the first zone and into a second zone and moving a second separating chamber containing magnetisable packing material into the first zone;

d. removing the magnetisable particles attracted to the packing material from the first separating chamber within the second zone; and e. concurrently with (d), passing a further quantity of said fluid having magnetisable particles suspended therein through said second separating chamber within the first zone, so that the magnetisable particles are magnetised by the magnetic field and attracted to the packing material;

the high intensity magnetic field being continuously maintained in the first zone throughout (b) to (e).

According to another aspect of the invention there is provided apparatus, suitable for separating magnetisable particles from a fluid in which they are suspended, said apparatus comprising:

a. superconductive electromagnet means for establishing a continuous high intensity magnetic field in a first zone when the apparatus is in use;

b. a plurality of separating chambers;

c. two openings provided in each of the said separating chambers for permitting fluid to enter and leave the separating chambers;

d. a porous and magnetisable packing material provided in each of the separating chambers;

e. means for removing said separating chambers one at a time into, and out of, the first zone, whilst the magnetic field is continuously maintained in the first zone;

f. means for passing fluid having magnetisable particles suspended therein through a separating chamber, when that separating chamber is positioned within the first zone, by way of one of the two openings provided therein, so that the magnetisable particles are magnetised by the high intensity magnetic field and attracted to the packing material within that separating chamber, whilst the fluid passes through the packing material and exits through the other opening in the separating chamber; and g. removal means for removing the magnetisable particles attracted to the packing material within a separating chamber, when that separating chamber is positioned in a second zone remote from said first zone.

The magnetic extraction efficiency can be shown to be approximately directly proportional to the magnetic field intensity applied in the first zone and approximately inversely proportional to the velocity of flow of fluid through the separating chambers. Because very much greater field intensities are attainable with superconductive magnets, a given separation can be carried out at a greater velocity of fluid with consequent better utilisation of capital equipment utilising the apparatus of the invention, as compared with apparatus utilising a conventional magnet.

Since the magnetic field is continuously applied during operation in the apparatus of the invention, the superconductive magnet is not repeatedly energised and de-energised which would make its operation uneconomic. Fluid having magnetisable particles in suspension therein may be passed through the apparatus during a high proportion of its operating cycle and more fluid may therefore be processed in a given time utilising this apparatus than utilising apparatus of a more conventional construction.

The magnetic field intensity will generally be at least 10,000 gauss and may be as high as 60,000 gauss or more.

The fluid having magnetisable particles suspended therein may be a slurry of water and substantially non-magnetisable material, having magnetisable particles therein. The velocity at which the slurry is passed through each separating chamber may be at least 30 cm/min. and not more than 1,000 cm/min. The residence time of the slurry in the first zone may be between about 3 seconds and about 2 minutes, and preferably between about 5 seconds and about 25 seconds.

Preferably the magnetisable particles are removed from the first separating chamber within the second zone by flushing with a fluid. In one possible embodiment, the magnetisable particles are removed from the packing material within each separating chamber by reducing the residual magnetism of the packing material, possibly by introducing the separating chambers into a degaussing coil, and progressively reducing the amplitude of the alternating current applied to this coil so as to take the magnetisation of the material around a smaller and smaller hysteresis loop until the residual magnetism of the material is effectively zero; and then flushing out the material with a fluid.

The electromagnet means may include an electromagnet coil which comprises a conductor made from an alloy of niobium and titanium and which is superconductive at the temperature of liquid helium.

The apparatus is provided preferably with only two separating chambers. Each separating chamber may have axial symmetry, and the separating chambers may be axially aligned and linked together, so as to be movable by means coupled to one of the separating chambers. The means for moving the separating chambers may comprise a pinion which co-operates with a rack coupled to one of the separating chambers.

In one embodiment of the invention, each separating chamber is provided with two openings at one end thereof, one of which openings is connected to a duct which extends to that end of the chamber which is remote from the openings, whereby fluid can enter the chamber at one end and can leave the chamber at the same end after passing through the porous packing of magnetisable material.

The packing material may comprise a stainless steel wool. In that case about 2% to 40% of the total volume occupied by the packing material may be occupied by stainless steel, the remainder of the volume being void. The packing material may alternatively be particulate, in which case about 10% to 75% of the total volume occupied by the packing material may be occupied by particles, the remainder of the volume being void.

The fluid supplied to the magnetic separation apparatus will generally contain at least 10% and not more than 40% by weight of solids.

With the apparatus according to the invention a heavy iron return frame is unnecessary and it is therefore possible to move a separating chamber into and out of the zone in which the magnetic field is applied.

The method of the invention preferably additionally comprises:

1. moving the second separating chamber out of the first zone and into a third zone and moving the first separating chamber into the first zone; and 2. removing the magnetisable particles attracted to the packing material from the second separating chamber within the third zone;

the high intensity magnetic field being continuously maintained in the first zone throughout (1) and (2) as well as throughout (*b*) to (*e*).

For a better understanding of the invention, and to show how the same may be carried into effect, reference will now be made, by way of example, to the accompanying drawings.

DETAILED DESCRIPTION OF THE INVENTION

Figure 1:
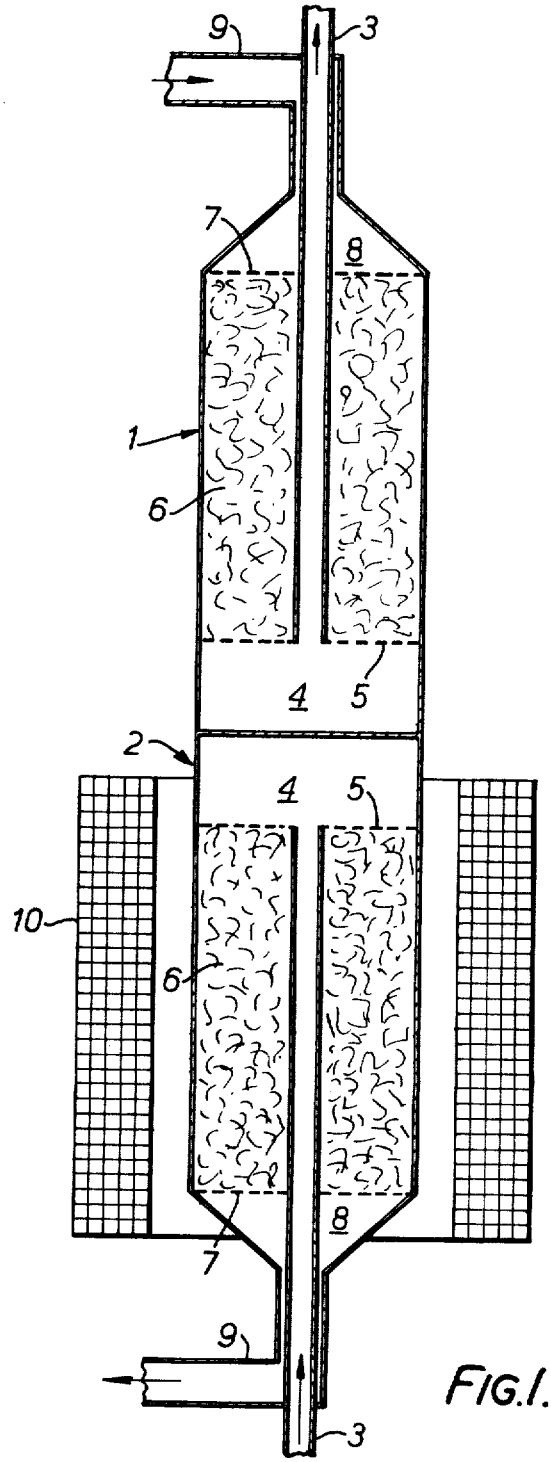
FIG. 1 shows diagrammatically an axial cross-sectional view of one embodiment of magnetic separation apparatus according to the invention.

The apparatus illustrated in FIG. 1 comprises two separating chambers 1 and 2 which are rigidly connected end-to-end, there being no communication between the two chambers. Each chamber is provided with a central axial conduit 3 through which a light-coloured aqueous slurry of a pigment containing discolouring impurities of paramagnetic or ferromagnetic material is fed to a first compartment 4. From the compartment 4 the aqueous slurry passes through a first perforated partition 5, a packing of corrosion-resistant iron or steel wool and a second perforated partition 7 into a second compartment 8 which it leaves by a conduit 9. The apparatus also comprises an electromagnet coil 10. The region of most intense field of the electromagnet coil is a cylindrical bore defined thereby. The separating chambers are mounted on means (see FIG. 2) whereby either one of the chambers can be positioned in the cylindrical bore of the electromagnet coil 10 whilst the other separating chamber remains substantially out of the influence of the magnetic field of the electromagnet coil.

The electromagnet coil 10 comprises a conductor, made for example of an alloy of niobium and tin, titanium or gallium or an alloy of vanadium and gallium, which is superconductive at the temperature of liquid helium. The coil 10 is encased in a four-walled jacket (not shown), both surfaces of each wall having a radiation-reflecting surface. The space between the first and second walls contains liquid helium; the space between the second and third walls contains liquid nitrogen (or liquid air); and the space between the third and fourth walls is evacuated. The thickness of the walls and the spaces therebetween within the cylindrical bore of the electromagnet coil is kept as small as possible in order to make the maximum volume within the bore, where the magnetic field is strongest, available for the separating chambers.

Figure 2:
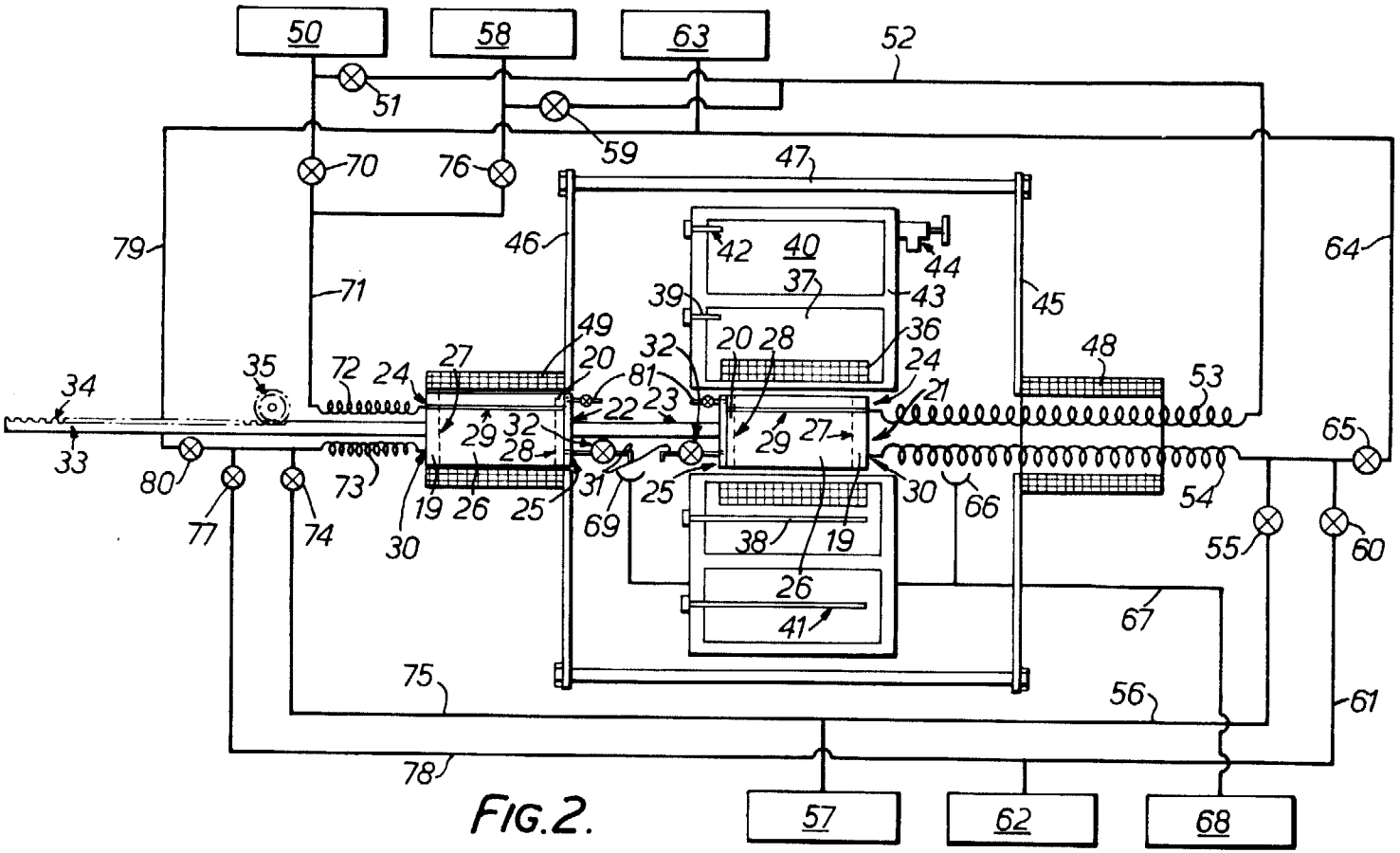
FIG. 2 shows diagrammatically and partly in cross-section a second embodiment of magnetic separation apparatus according to the invention.

The apparatus illustrated in FIG. 2 comprises two cylindrical separating chambers 21 and 22 which are rigidly connected by a rod 23 there being no communication between the two chambers. Each chamber is provided with end walls 24 and 25 and a packing 26 of stainless iron wool which is contained between a first perforated partition 27 and a second perforated partition 28. A conduit 29 for introducing feed suspension and rinsing water at low pressure passes through the packing 26 and communicates with a compartment 20 between the second perforated partition 28 and the end wall 25 of the separating chambers. A first outlet 30 communicates with a compartment 19 between the first perforated partition 27 and the end wall 24 of the separating chamber, and serves for the discharge of product suspension and washings and for the introduction of high pressure flushing water, and a second outlet 31 provided with a valve 32 is used to discharge flushing water. End wall 25 of both separating chambers is formed from a relatively massive soft iron plate. The separating chambers 21 and 22 are moved from a first position in which one separating chamber is within a zone in which a high intensity magnetic field is established to a second position in which the other separating chamber is within this zone by means of a rod 33 provided with a rack 34 which co-operates with a pinion 35 which can be driven in either sense by driving means (not shown), for example an electric motor. The high intensity magnetic field is established by means of a refrigerated electromagnet assembly.

The electromagnet coil 36 comprises a conductor, made for example of an alloy of niobium and tin, titanium or gallium or an alloy of vanadium and gallium, which is superconductive at the temperature of liquid helium. The coil 36 is encased in a four-walled jacket, both surfaces of each wall having a radiation-reflecting surface. A first annular chamber 37 formed between the first and second walls contains liquid helium; a second annular chamber 40, coaxial with the first chamber 37 is formed between the second and third walls and contains liquid nitrogen (or liquid air); and a third chamber 43, formed between the second, third and fourth walls, completely surrounds the first and second chambers and is evacuated. The first annular chamber 37 is provided with an inlet conduit 38 and a vent 39, the second annular chamber 40 is provided with an inlet conduit 41 and a vent 42 and the third chamber is evacuated via a valve 44 which communicates with a suitable vacuum pump (not shown).

Circular soft iron shields 45 and 46 are provided, one on each side of the refrigerated electromagnet assembly and each has a central circular hole of diameter such that the separating chambers 21 and 22 will just slide through the hole. The shields 5 and 6 are positioned such that, when one separating chamber is within the zone of the high intensity magnetic field, the soft iron end wall 25 of the other separating chamber is coplanar with one of the two iron shields. The soft iron shields 45 and 46 and separating chamber end walls 25 serve to shield the separating chambers 21 and 22 from the intense magnetic field when the separating chambers are in the position in which the packing is substantially demagnetised, and in addition help to lessen the forces on the refrigerated electromagnet assembly when a separating chamber is removed from the zone of intense magnetic field. The refrigerated electromagnet assembly is of relatively light construction and may be distorted by large forces. The forces acting on the assembly are largely balanced by ensuring that, as one separating chamber is withdrawn from the zone of high magnetic field intensity, the other separating chamber enters the zone. The soft iron shields 45 and 46 are rigidly mounted by means of a plurality of threaded rods 47. Degaussing coils 48 and 49, cylindrical in shape and having a diameter a little larger than that of the separating chambers, are provided adjacent the soft iron shields 25 on the side remote from the refrigerated electromagnet assembly. An alternating current which is steadily reduced to zero can be applied to the degaussing coils from a suitable supply (not shown).

MODE OF OPERATION OF THE INVENTION

In operation of the apparatus illustrated in FIG. 1, the electromagnet coil is energized and the liquid helium in the space between the first and second walls ensures that the temperature of the coil is maintained in the temperature range in which conditions of superconductivity prevail. The aqueous slurry which is preferably deflocculated is fed continuously to the chamber 2 while it is within the cylindrical bore. After a predetermined period which is governed by the time which has been found by experiment to elapse before the passages through the packing become appreciably choked with particles of magnetic impurities, the supply of feed slurry to the chamber 2 is discontinued and the positions of the two separating chambers are changed to bring the chamber 1 into the cylindrical bore while displacing the chamber 2 to a position substantially outside the magnetic field. The chamber 1 is connected to the supply of feed suspension and the chamber 2 is connected to a source of clean water at high pressure which flushes out the magnetic impurities. The clean water is preferably passed through the chamber in the opposite direction to the direction of passage of feed suspension.

In operation of the apparatus illustrated in FIG. 2, a high intensity magnetic field is maintained continuously in the cylindrical bore of the refrigerated electromagnet assembly. Separating chamber 21 is shown within the zone of the high intensity magnetic field and separating chamber 22 is in one of the two positions for demagnetising and flushing the packing. Feed suspension which is preferably deflocculated flows from a first container 50 through a valve 51 and a conduit 52 which includes a flexible portion 53 into a feed conduit 29 of separating chamber 21. Product suspension having a reduced content of magnetic impurities as compared to the feed suspension leaves separating chamber 21 through outlet 30 and a flexible conduit 54 and flows through a valve 55 and a conduit 56 into a first storage vessel 57 for product. After a predetermined period which has been found by experiment to elapse before the passages through the packing become appreciably choked with particles of magnetic impurities, valves 51 and 55 are closed and low pressure rinsing water is allowed to flow from a second container 58 through a valve 59 and thus into the feed conduit 29 of the separating chamber 21. A dilute suspension of physically entrained non-magnetic particles flows through the flexible conduit 54, a valve 60 and a conduit 61 into a second storage vessel 62 for a "middlings" fraction. Valves 59 and 60 are then closed and the pinion 35 is rotated to move separating chamber 22 into the zone of the high intensity magnetic field and separating chamber 21 into the degaussing coil 48. Flushing water at high pressure flows from a third container 63 through a conduit 64 and a valve 65 into the flexible conduit 54, and a suspension of magnetic particles is discharged through a conduit 31 and a valve 32 into a tundish 66, whence it flows through a conduit 67 into a third storage vessel 68 for the magnetic fraction. In this way the packing of the separating chamber is flushed out in a direction opposite to that of the flow of feed suspension and wash water. A second tundish 69 is provided to receive the magnetic fraction from separating chamber 22 when it is positioned within the degaussing coil 49. The packing is simultaneously flushed with water and substantially demagnetised by supplying to the degaussing coil 48 an alternating current which is gradually reduced to zero. Meanwhile feed suspension is supplied to separating chamber 22 through a valve 70 and a conduit 71 which includes a flexible portion 72. The product suspension leaves the separating chamber 22 through outlet 30 and a flexible conduit 73 and flows through a valve 74 and a conduit 75 into the first storage vessel 57. Rinsing water is supplied to separating chamber 22 through a valve 76 and the "middlings" fraction flows through a valve 77 and a conduit 78 into the second storage vessel 62. When separating chamber 22 is in the degaussing coil 49, high pressure flushing water is supplied through a conduit 79 and a valve 80. An air vent which includes a valve is provided at the highest point of each of the two separating chambers 21 and 22 to permit the escape of any air which enters the separating chambers with the feed suspension or washing water.

The volume of feed suspension passed through the separating chamber before removing the separating chamber from the zone of high intensity magnetic field would generally be not greater than fifteen times the volume of the separating chamber, and the volume of rinse water would generally be in the range from two to five times the volume of the separating chamber. The separating chamber would generally be flushed out with water at high pressure for about 1 to about 5 minutes.

The electromagnet coil is not provided with a return frame because I have found that the magnetic field strength obtainable in the cylindrical bore when the coil is in its super-conductive condition is sufficient, without using a return frame, to separate successfully impurities having a magnetic susceptibility as low as $8 \times 10^{-5}$ (in SI units) from an aqueous slurry. Since no return frame is used it is possible to use two separating chambers and displace them so that they are alternately inside and outside the cylindrical bore. Thus, it is not necessary repeatedly to energize and de-energize the electromagnet coil (which, it will be recalled, is uneconomic in the case of a superconductor coil) in order to flush magnetic particles from the packing, and there is no need to interrupt the magnetic separation in order to carry out the flushing.

In a modified form of apparatus the chambers may be mounted on a rotatable bar or wheel which is used to move the chambers in a circular path, always in the same sense.

Instead of using iron or steel wool for the packing material, spheres, pellets, fillings or particles of an irregular shape, formed, for example, by the action of a milling machine on a block of corrosion-resistant ferromagnetic material, may be used. Of the total volume occupied by a particulate packing, about 10% to 75%, and preferably 30% to 70%, is occupied by solid packing material, the remainder of the volume being void. If the packing is an iron or steel wool or a metal foam, about 2% - 40% of the total volume is occupied by solid packing material, the remainder of the volume being void.

The light-coloured pigment would generally be kaolinite or a clay comprising nacrite, dickite or halloysite, but other mineral pigments could also be treated.

The velocity of flow of the feed suspension is generally between 30 cm/min and 1000 cm/min, and is preferably not greater than 600 cm/min.

The invention is illustrated by the following Examples.

EXAMPLE 1

An English kaolin clay having a particle size distribution such that 43% by weight consisted of particles smaller than 2 microns equivalent spherical diameter (e.s.d.) and 11% by weight consisted of particles larger than 10 microns equivalent spherical diameter, an initial reflectance to violet light of wavelength 458 nm of 84.8% (magnesium oxide = 100%) and an initial iron content of 0.80% by weight of $Fe_2O_3$ was mixed with water containing a dispersing agent to form a fully deflocculated suspension having a specific gravity of 1.100 (i.e. the suspension contained about 18% by weight of solids).

Samples of this suspension were passed through a conventional magnetic separator operating at a magnetic field intensity of 15,000 gauss and having a massive iron return frame and a single fixed separating chamber, and a superconducting magnetic separator according to the invention operating at a magnetic field intensity of 50,000 gauss and having two movable separating chambers and no return frame.

In each case the separating chambers had a length of 50.5 cm and a diameter of 3.5 cm and were packed with stainless iron wool to a voidage of 95% by volume.

The composition of the stainless iron may be, for example:

| Element | % by weight |
|---|---|
| Carbon | 0.04 - 1.20 |
| Silicon | 0.0 - 1.0 |
| Manganese | 0.0 - 1.5 |
| Chromium | 4.0 - 27.0 |
| Molybdenum | 0.0 - 1.6 |
| Nickel | 0.0 - 2.5 |
| Iron | balance |

The operating conditions for each magnetic separator were chosen to give substantially identical beneficiations of the feed suspension and the rates of flow of the feed suspension were compared. The results are set forth in Table 1 below:

Table 1

| | % by weight of particles smaller than 2 μm e.s.d. | % by weight of particles larger than 10μm e.s.d. | % by wt. $Fe_2O_3$ | % reflectance to light of 458 nm wave-length | % by wt. recovery of product | velocity of feed cm/min. |
|---|---|---|---|---|---|---|
| Conventional magnetic separator | 46 | 9 | 0.54 | 87.8 | 88 | 63 |
| Superconducting magnetic separator | 44 | 11 | 0.54 | 88.0 | 86 | 254 |

The times taken for the individual steps in the operating cycles are given in Table II below expressed as percentages of the time taken for a complete cycle:

Table II

| | Conventional magnetic separator | Superconducting magnetic separator |
|---|---|---|
| Feed time | 50.5% | 60.6% |
| Rinse time | 33.7% | 24.2% |
| Flush time | 15.8% | — |
| Time to move separating chambers | — | 15.2% |

The non-productive time, i.e. the time taken for rinsing and flushing the packing, in the case of the conventional magnetic separator was 49.5% of the total time. In the case of the superconducting magnetic separator the use of two movable separating chambers permitted the first separating chamber to be flushed with high pressure water while the second separating chamber was undergoing the feed and rinse steps. In addition, because of the more intense field in the superconducting magnetic separator it is possible to pass the feed suspension through at a greater velocity. In order to minimise the proportion of magnetic particles in the "middlings" fraction the rinse water is passed through the packing in the same direction as the feed suspension and at a velocity not greater than that of the feed suspension. For this reason the time taken by the rinsing step in the case of the superconducting magnetic separator is considerably less than in the case of the conventional magnetic separator. The non-productive time in the case of the superconducting magnetic separator was 39.4% of the total time.

The rate of production of dry beneficiated kaolin in the case of the conventional magnetic separator was 2.8 kg/hour and in the case of the superconducting magnetic separator according to the invention was 11.6 kg/hour.

EXAMPLE 2

An English kaolin clay having a particle size distribution such that 45% by weight consisted of particles smaller than 2 microns equivalent spherical diameter and 14% by weight consisted of particles larger than 10 microns equivalent spherical diameter, an initial reflectance to violet light of wavelength 458 nm of 84.8% and an initial iron content of 0.85% by weight of $Fe_2O_3$ was mixed with water containing a dispersing agent to form a fully deflocculated suspension having a specific gravity of 1.078 (i.e. the suspension contained about 12% by weight of solids).

Samples of this suspension were passed through a superconducting magnetic separator having a single fixed separating chamber, and a superconducting magnetic separator according to the invention having two movable separating chambers.

In each case the separating chambers had a length of 50.5 cm and a diameter of 3.5 cm and were packed with stainless iron wool to a voidage of 94.9% by volume.

The magnetic field intensity in each case was 30,000 gauss. In each case the feed suspension was passed through the separating chamber at a rate of 145.5 cm/min. or 1330 cc/min. and the total volume of feed suspension passed through was equal to ten times the volume of the separating chamber. The beneficiation of the clay was the same in each case and the results are set forth in Table III below:

Table III

| | % by weight of particles smaller than 2 μm e.s.d. | % by weight of particles larger than 10 μm e.s.d. | % by wt. $Fe_2O_3$ | % reflectance to light of 458 nm wave-length | % by wt. recovery of product |
|---|---|---|---|---|---|
| Feed | 45 | 14 | 0.85 | 84.8 | — |
| Product | 46 | 10 | 0.56 | 87.9 | 90 |

The time taken for the individual steps in the operating cycles are given in Table IV below expressed as percentages of the time taken for a complete cycle:

Table IV

| | Superconducting magnetic separator with 1 separating chamber | Superconducting magnetic separator with 2 separating chambers |
|---|---|---|
| Feed time | 54.6% | 64.8% |
| Rinse time | 21.8% | 25.9% |
| Flush time | 23.6% | — |
| Time to move separating chambers | — | 9.3% |

The non-productive time was therefore 45.4% in the case of the separator with one chamber but only 35.2% in the case of the separator with two chambers. The rate of production by dry beneficiated kaolin in the case of the separator with one chamber was 4.89 kg/hr and in the case of the separator with two chambers was 5.80 kg/hour.

The residence time of the feed suspension in the separating chamber will generally be between 3 seconds and 2 minutes and, more preferably, will be between 5 seconds and 25 seconds.

It will be obvious to one skilled in the art that many changes may be made to the apparatus hereinbefore described without departing from the scope of the invention.

I claim:

1. Apparatus, suitable for separating magnetisable particles from a fluid in which they are suspended, said apparatus comprising:

a. superconductive electromagnet means for establishing a continuous high intensity magnetic field in a first zone, b. a plurality of elongate separating chambers coupled to each other with their axes aligned along a common axial direction, c. two openings provided in each of the said separating chambers for permitting fluid to enter and leave the separating chambers, the separating chambers being otherwise completely enclosed, d. a fluid permeable and magnetisable packing material provided in each of the separating chambers so that fluid flowing between the two openings passes through the packing material, e. means for moving said separating chambers reciprocatingly in the axial direction into and out of the first zone so as to move one of the separating chambers into the first zone and the other or another separating chamber outside of the first zone, f. means for passing fluid having magnetisable particles suspended therein into one of the openings of the one separating chamber, when the one separating chamber is positioned within the first zone, wherein magnetisable particles are magnetised by the high intensity magnetic field and are attracted to the packing material within that separating chamber, as the fluid passes through the packing material and exits through the other opening in the separating chamber, and g. removal means for removing the magnetisable particles attracted to the packing material within a separating chamber which has been in the first zone, when that separating chamber has been moved into a second zone by said moving means.

2. Apparatus as claimed in claim 1, wherein said plurality is two, the two separating chambers being linked together and the means for moving the separating chambers into and out of the first zone being reciprocating means which are intended to move each of the separating chambers into a different zone remote from the first zone for removal of the magnetisable particles attracted to the packing material, the two remote zones being disposed on opposite sides of the first zone.

3. Apparatus as claimed in claim 2, wherein each separating chamber has axial symmetry, and the separating chambers are axially aligned and rigidly linked together, so as to be axially movable by means coupled to one of the separating chambers.

4. Apparatus as claimed in claim 3, wherein the reciprocating means comprises a pinion which engages with a rack coupled to one of the separating chambers, so that, when the pinion is rotated by a suitable amount, the rack is displaced longitudinally by a sufficient amount to move one separating chamber from the first zone into one of said remote zones and to move the other separating chamber from the other said remote zone into the first zone.

5. Apparatus as claimed in claim 2, wherein the removal means includes flushing means for flushing a fluid through each separating chamber within each remote zone.

6. Apparatus as claimed in claim 5, wherein the removal means also includes magnetic degaussing means positioned in the remote zones for reducing the residual magnetism of the packing material within each separating chamber prior to flushing with a fluid.

7. Apparatus as claimed in claim 1, wherein each separating chamber is provided with two openings at one end thereof, one of which openings is connected to a duct which extends to that end of the chamber which is remote from the openings, whereby fluid can enter the chamber at one end and leave the chamber at the same end after passing through the packing material.

8. Apparatus as claimed in claim 1, wherein the superconductive electromagnet means includes an electromagnet coil which comprises a conductor made from an alloy of niobium and titanium and which is superconductive at the temperature of liquid helium.

9. Apparatus as claimed in claim 1, wherein the packing material comprises a stainless steel wool.

10. Apparatus as claimed in claim 9, wherein about 2% to 40% of the total volume occupied by the packing material is occupied by stainless steel, the remainder of the volume being void.

11. Apparatus as claimed in claim 1, wherein the packing material is particulate.

12. Apparatus as claimed in claim 11, wherein about 10% to 75% of the total volume occupied by the packing material is occupied by particles, the remainder of the volume being void.

13. A method of separating magnetisable particles from a fluid in which they are suspended, utilizing a plurality of elongate separating chambers coupled to each other with their axes aligned along a common axial direction, wherein each separating chamber is completely enclosed except for two openings for permitting fluid to enter and leave the separating chamber and wherein each separating chamber contains a fluid permeable and magnetisable packing material so disposed within the separating chamber that fluid flowing between the two openings passes through the packing material, which method comprises:

a. establishing a high intensity magnetic field in a first zone, b. passing a quantity of said fluid having magnetisable particles suspended therein through one opening of one of the separating chambers disposed within the first zone, so that the magnetisable particles are magnetised by the magnetic field and attracted to the packing material, as the fluid passes through the packing material and exits through the other opening, c. moving the one separating chamber in a first sense along the axial direction out of the first zone and into a second zone and moving another separating chamber in the axial direction into the first zone, d. removing the magnetisable particles attracted to the packing material from the one separating chamber within the second zone, e. concurrently with (d), passing a further quantity of said fluid having magnetisable particles suspended therein to one opening of said another separating chamber within the first zone, so that the magnetisable particles are magnetised by the magnetic field and attracted to the packing material, as the fluid passes through the packing material and exits through the other opening, f. where necessary repeating steps (c) to (e) until all of said plurality of separating chambers have passed through said first zone, g. repeating steps (c) to (f) by moving said plurality of separating chambers in the sense opposite to the first sense along the axial direction, the high intensity magnetic field being continuously maintained in the first zone throughout (b) to (g).

14. A method as claimed in claim 13, which method additionally comprises:

1. moving the second separating chamber out of the first zone and into a third zone and moving the first separating chamber into the first zone; and
2. removing the magnetisable particles attracted to the packing material from the second separating chamber within the third zone;

the high intensity magnetic field being continuously maintained in the first zone throughout (1) and (2) as well as throughout (b) to (e).

15. A method as claimed in claim 13, wherein the fluid having magnetisable particles suspended therein is a slurry of water and substantially non-magnetisable material, having magnetisable particles therein.

16. A method as claimed in claim 15, wherein the velocity at which the slurry is passed through each separating chamber is at least 30 cm/min.

17. A method as claimed in claim 15, wherein the velocity at which the slurry is passed through each separating chamber is not more than 1000 cm/min.

18. A method as claimed in claim 17, wherein the velocity at which the slurry is passed through each separating chamber is not more than 600 cm/min.

19. A method as claimed in claim 15, wherein the residence time of the slurry in the first zone is between about 3 seconds and about 2 minutes.

20. A method as claimed in claim 19, wherein the residence time of the slurry in the first zone is between about 5 seconds and about 25 seconds.

21. A method as claimed in claim 13, wherein the applied magnetic field has an intensity of at least 30,000 gauss.

22. A method as claimed in claim 13, wherein the magnetisable particles are removed from the first separating chamber within the second zone by flushing with a fluid.

23. A method as claimed in claim 13, wherein the magnetisable particles are removed from the first separating chamber within the second zone by reducing the residual magnetism of the packing material and flushing with a fluid.

24. A method as claimed in claim 15, wherein the slurry is defloculated before being passed through a separating chamber.

* * * * *